US006394626B1

(12) United States Patent
McColloch

(10) Patent No.: US 6,394,626 B1
(45) Date of Patent: May 28, 2002

(54) FLEXIBLE LIGHT TRACK FOR SIGNAGE

(75) Inventor: Larry McColloch, Santa Clara, CA (US)

(73) Assignee: LumiLeds Lighting, U.S., LLC, San Jose, CA (US)

( * ) Notice: Subject to any disclaimer, the term of this patent is extended or adjusted under 35 U.S.C. 154(b) by 0 days.

(21) Appl. No.: 09/547,380

(22) Filed: Apr. 11, 2000

(51) Int. Cl.[7] ..... F21V 23/06; F21V 21/35

(52) U.S. Cl. ..... 362/251; 362/226; 362/231; 362/250; 362/800

(58) Field of Search ..... 362/219, 226, 362/227, 235, 236, 249, 251, 800, 250, 230, 231; 313/500, 510; 257/88, 92

(56) References Cited

U.S. PATENT DOCUMENTS

| | | | | | |
|---|---|---|---|---|---|
| 4,855,882 | A | * | 8/1989 | Boss | 362/249 |
| 4,879,826 | A | | 11/1989 | Wittke | 40/551 |
| 5,045,981 | A | * | 9/1991 | Nagano | 362/226 |
| 5,490,048 | A | * | 2/1996 | Brassier et al. | 362/249 |
| 5,559,681 | A | * | 9/1996 | Duarte | 362/251 |
| 5,567,037 | A | * | 10/1996 | Ferber | 362/249 |
| 5,672,000 | A | * | 9/1997 | Lin | 362/249 |
| 5,785,411 | A | * | 7/1998 | Komai et al. | 362/219 |
| 5,829,865 | A | * | 11/1998 | Ahroni | 362/226 |
| 5,931,577 | A | * | 8/1999 | Ishibashi | 362/249 |
| 6,135,615 | A | * | 10/2000 | Lee | 362/226 |

FOREIGN PATENT DOCUMENTS

| | | |
|---|---|---|
| CH | 673 349 | 2/1990 |
| DE | 36 36 347 | 4/1988 |
| GB | 2 294 148 | 4/1996 |
| JP | 04 116684 | 4/1992 |

* cited by examiner

*Primary Examiner*—Alan Cariaso
(74) *Attorney, Agent, or Firm*—Skjerven Morrill MacPherson LLP

(57) ABSTRACT

The invention is an outdoor lighting display using light emitting devices. A flexible light track is secured at the bottom of a channel, e.g. a letter or symbol. A top corresponding to the shape of the channel covers the channel to protect the flexible light track from weather changes. The flexible light track includes a plurality of plastic modules having electrical connectors and respective tracks. Light emitting devices (LEDs) are inserted in the plastic modules. Electrical wires are positioned in the tracks of the plastic modules such that the LEDs are electrically connected in parallel.

11 Claims, 6 Drawing Sheets

FLEXIBLE LIGHT TRACK FOR SIGNAGE

FIELD OF THE INVENTION

The invention is directed towards the field of illuminated signage particularly towards using light emitting diodes in channel letters or band lights.

BACKGROUND

Prior art in the sign industry is mostly neon, florescent and incandescent lighting. Neon has been the predominant illumination source for commercial signage. It is used by many vendors and is available globally. Neon has well known problems. Neon is hard to bend to fit 12-inch or smaller channel letters. Neon has difficulty starting in cold weather, e.g. Minnesota in winter. The associated mean time to failure depends upon the operating environment, often 3 to 5 years of use. The operating voltage of 1000 volts that follows a turn-on voltage of many thousands of electrical volts, e.g. 10,000 volts is a recognized public safety hazard. Furthermore, disposal of the mercury used in some neon signs is an recognized environmental hazard.

Florescent lighting is used in many larger commercial signs. It is very inexpensive technology with well-known properties. While there are some shaped florescent lamps, most are straight tubes having a length between two and eight feet. This limits their use to very large signs. Similar to neon, florescent lamps are difficult to start at cold temperature and a short mean time to failure. The lamps are powered using AC voltages (120 or 220 VAC). This is still considered a high voltage level and therefore public safety hazard. Florescent lights are typically available in white that limits their applications in signage.

Incandescent lighting is comparably inexpensive next to neon and florescent lighting. Unlike the other lighting mentioned, they have no problem with cold weather. However, they have a relatively short mean time to failure because they produce a lot of heat and are fragile. They are the least power efficient option for commercial signage and the power cost is often significant. They can be operated at voltage levels safe to the public. Furthermore, the color shifts continuously during their life.

Light emitting devices (LEDs) are more power efficient than incandescent and neon. LEDs are inherently long life devices, essentially life long devices for commercial signs. They are inherently single color light sources. As single color illuminators, they are more efficient then the other technologies mentioned for colored light. They are inherently rugged devices that do not need special handling for shipping or installation. Their quality is not dependent on skilled craftsmen. They are inherently low voltage, safe devices, often operating below 5 volts. In the prior art, the LEDs are mounted on printed circuit boards that are expensive and difficult to customize because they are inflexible. The LED light output is temperature dependent and degrades with use.

SUMMARY

The invention is an outdoor lighting display using light emitting devices. A flexible light track is secured at the bottom of a channel, e.g. a letter or symbol. A top corresponding to the shape of the channel covers the channel. The top is made of a translucent material, usually acrylic. The flexible light track includes a plurality of plastic modules having positive and negative electrical connectors and respective tracks. Light emitting devices (LEDs) are inserted in the plastic modules. The LEDs are more energy efficient than neon displays and are easier and less expensive to replace. Electrical wires are positioned in the tracks of the plastic modules such that the LEDs are electrically connected in parallel.

As the LED light output varies most directly with current, but the voltage across the LED varies with material type, temperature and manufacturing variations, the LEDs in a string are matched. There is less variation in light output when driven from a constant current source. The first LED of a string can be fed back to the system controller to allow the voltage to be set to maintain constant current in all modules of the string over temperature, and material type.

White light can be created by using two or three colored LED rails, usually a red, green, and blue (RGB) combination. Other colors can also be created by mixing light from two or more colored LED modules. The system controller may be open loop. When good color control, or color temperature control is needed, photo feedback is built into the controller. Precise control by open loop techniques is difficult because the light output from the LEDs varies with changes in temperature and degrades at differing rates for different material technologies. The photo diodes can be built into the controller, built into the LEDs, or mounted separately in the channel letter. The colored LEDs may be placed in discrete modules or integrated into a single module.

There are several techniques that can be used for color separation. The drawings show a photodiode in the LED package. The color separation occurs because each package contains only one light. An alternate color separation can use a single photodiode that sits within the channel letter where it is exposed to light reflected back from the transparent top and the color separation done by momentarily testing measuring each color sequentially. Since the balance between colors degrades slowly with age or temperature, the measurement could be made infrequently. The color separation can also be done with photodiodes that have color filters over the photo diodes. The color filter often chosen would be the X and Y filters described by the CIE organization.

BRIEF DESCRIPTION OF THE DRAWINGS

FIGS. 3A–B illustrate embodiments for the bendable clip assembly. FIG. 3C shows the snap clip.

DETAILED DESCRIPTION OF THE DRAWINGS

The invention is a flexible light track lit by a distributed power system. High voltage AC mains can be kept behind a wall and handled without extraordinary care. The system can be used in locations requiring channel letters or light bands that are white, dynamic, or custom shades. A flexible light track is preferably secured at the bottom of a channel-shaped housing, e.g. a channel light or light band. The LED rail can be fastened via bendable clip, adhesive, or a snap in plastic clip. A colored translucent top covers the housing to provide reflected sun light color during the daytime. The LEDs provide the illumination from underneath at night. The flexible light track includes a plurality of plastic modules with LEDs. The LEDs are more energy efficient than neon displays and are easier to assemble. They are inherently reliable and do not require servicing. A system controller powers the LED modules. The system controller can be a simple current source or current sink but can include additional features such as intensity control, dynamic changing colors or light levels, or to maintains color point in white light applications. The controller may compensate for LEDs over temperature and life of the LEDs using a photodiode signal. Electrical wires are positioned in the tracks of the plastic modules such that the LEDs are electrically connected in parallel strings.

Figure 1:
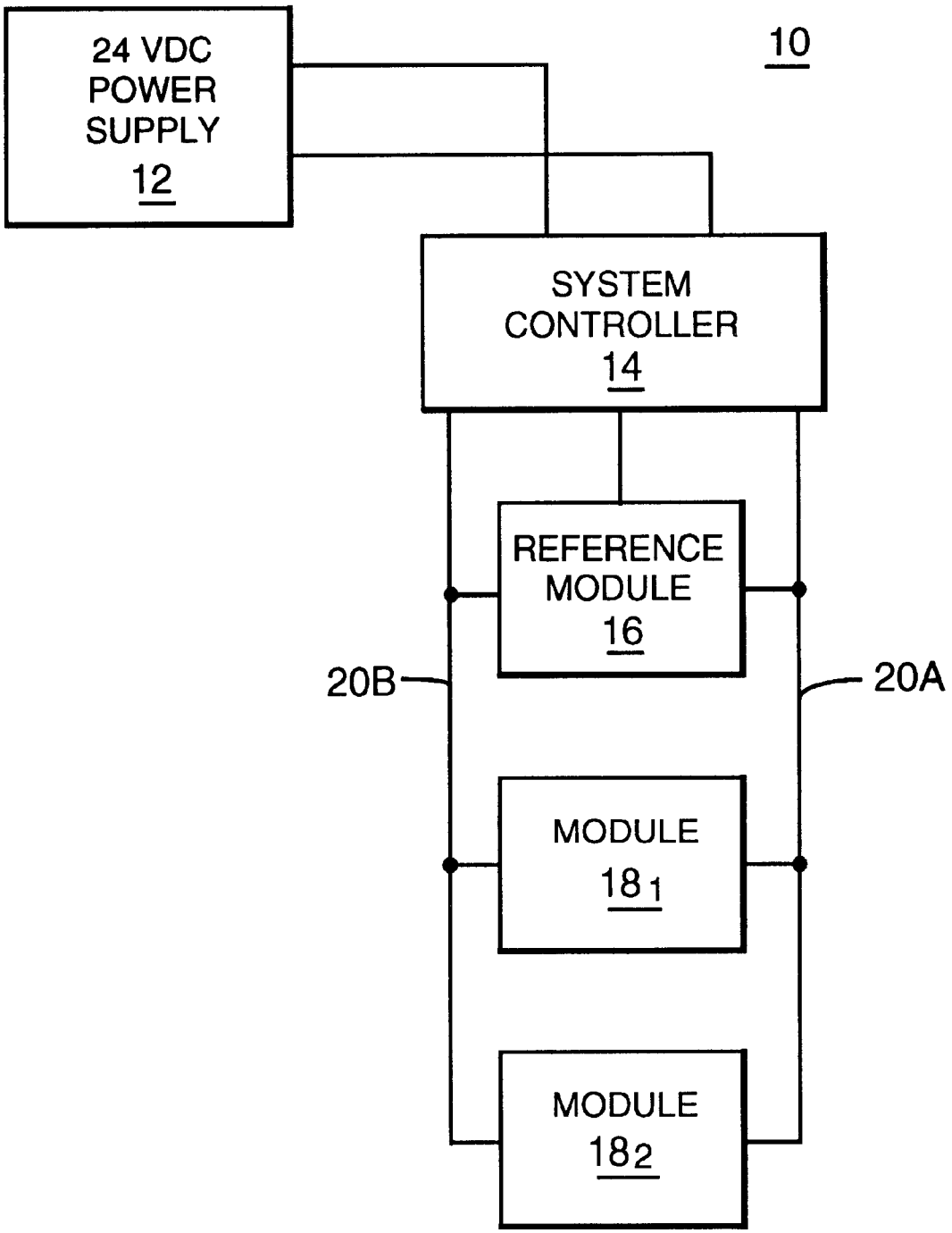
FIG. 1 shows a lighting system of the present invention.

FIG. 1 shows a schematic diagram of the present invention. The LED rail 10 is powered by an external supply 12, e.g. 24 VDC, with individual LED modules in strings powered by a LED controller 14. As the light output from an LED degrades slowly with time, an optional version of the system controller 14 can be used to power the LED rail lo via an optional reference module 16 to provide accurate color and intensity control. The flexible LED rail 10 includes a plurality of modules $\mathbf{18}_x$. The modules $\mathbf{18}_x$ are fastened to the channel letter and are electrically connected in parallel via two wires 20A, 20B.

Figure 2A:
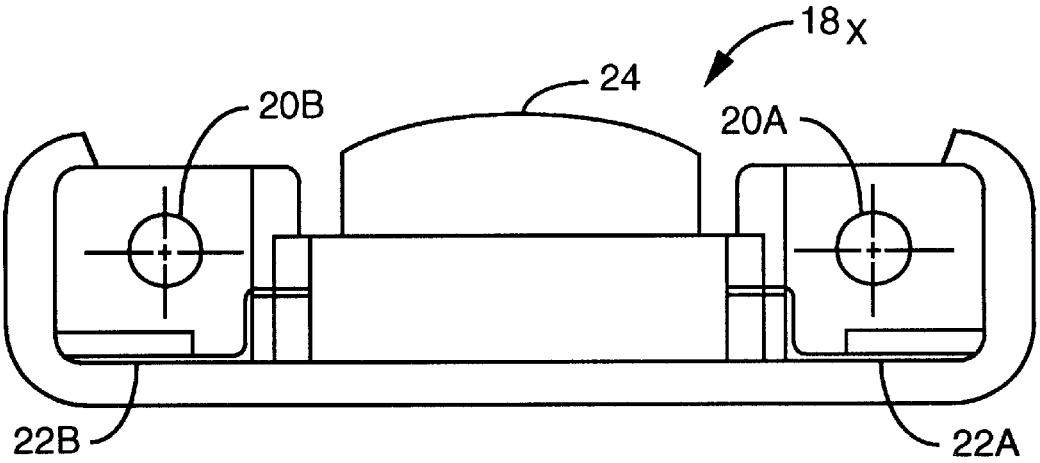
FIGS. 2A–C illustrate embodiments of the housing shown in FIG. 1.
Figure 2B:
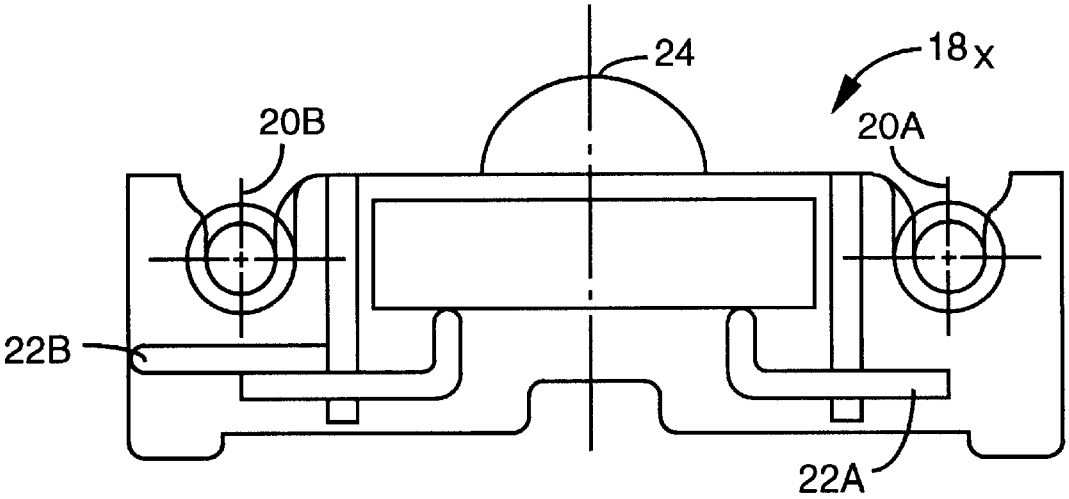
Figure 2C:
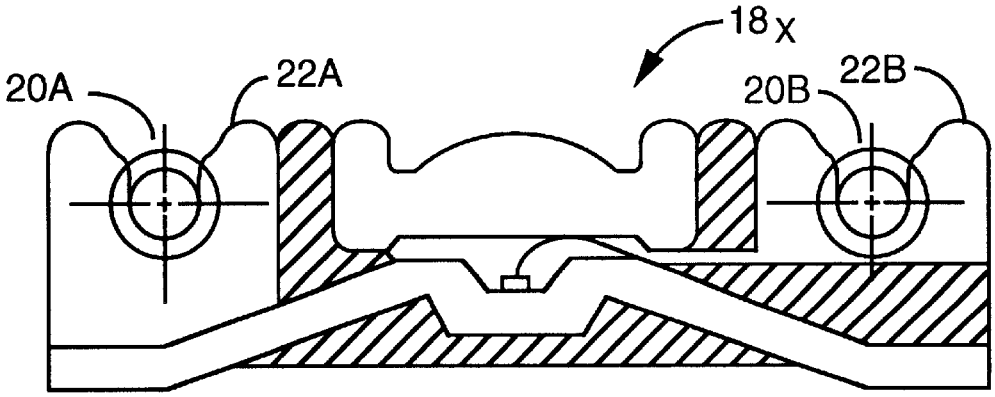

FIGS. 2A–C illustrate embodiments of module $\mathbf{18}_x$ shown in FIG. 1. The module $\mathbf{18}_x$ has electrical contacts 22A, 22B that form insulation displacement connectors for the two wires 20A, 20B from the LED rail and a lamp 24, e.g. LED. Each electrical contact 22A, 22B spans a corresponding track. The LED modules include a snap feature to allow a secondary optic (not shown) to be fastened over the LED. The secondary optic is used to change the radiation pattern to optimize for different depths, change apparent source size, or to create artistic patterns such as the crystal look. The lamp 24, e.g. a high power LED, is pressed, or soldered in to complete a module. A bendable clip assembly 26 retains the module and pre-loads against the lamp to create intimate thermal contact. Optionally, heat transfer goo or adhesive may be positioned between the bendable clip assembly 26 and the lamp 24 to promote heat transfer. In FIG. 2C, the LED 24 is integrated into the module.

The LEDs are held in place by a bendable clip assembly that includes a metal frame (bendable clip) and a mounting adhesive. The bendable clip mechanically holds the LED modules. The clip serves as a template for positioning the modules along the bottom of a channel, attaches the modules to the bottom of a channel, and serves as a heat sink for the LEDs. The bendable clip metal frame is formed sheet metal. The formed side walls have various slot cuts which allow the bendable clip to turn at large angles relative to the plane of the side walls, which allows the bendable clip to bend with a small tight radius around sharp corners or radii in channels.

Figure 3A:
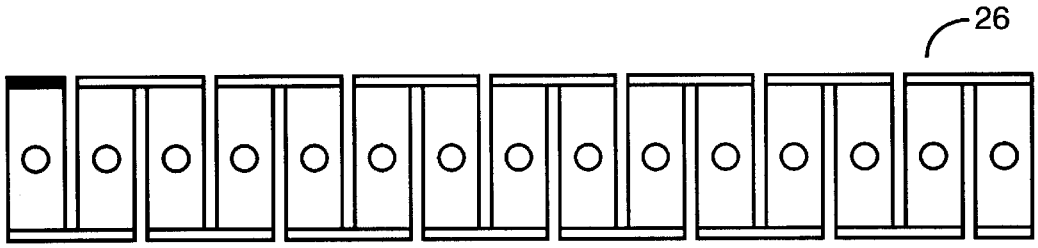
FIGS. 3A–C illustrate mounting techniques.
Figure 3B:
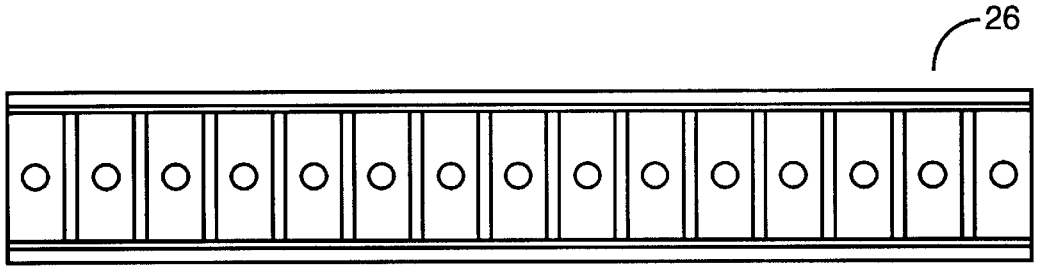
Figure 3C:
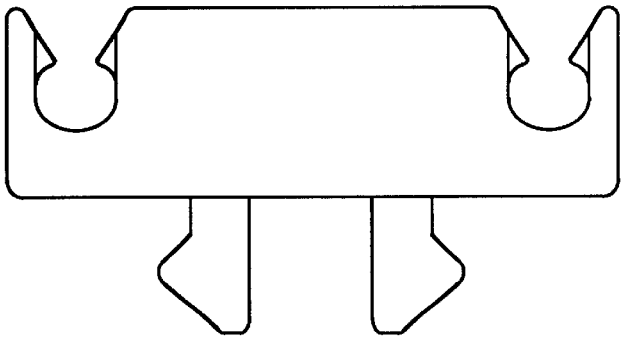

The bendable clip in FIGS. 3A–B mechanically holds the LED modules. The sidewalls of the bendable clip are the clips. The clips are bent or preloaded, so that when a module is inserted between the clips, compressive forces are applied onto the module to hold it in place. The module is inserted into the bendable clip from the top; during the insertion, the walls flex, elastically, outward and clamp onto the module.

Figure 4:
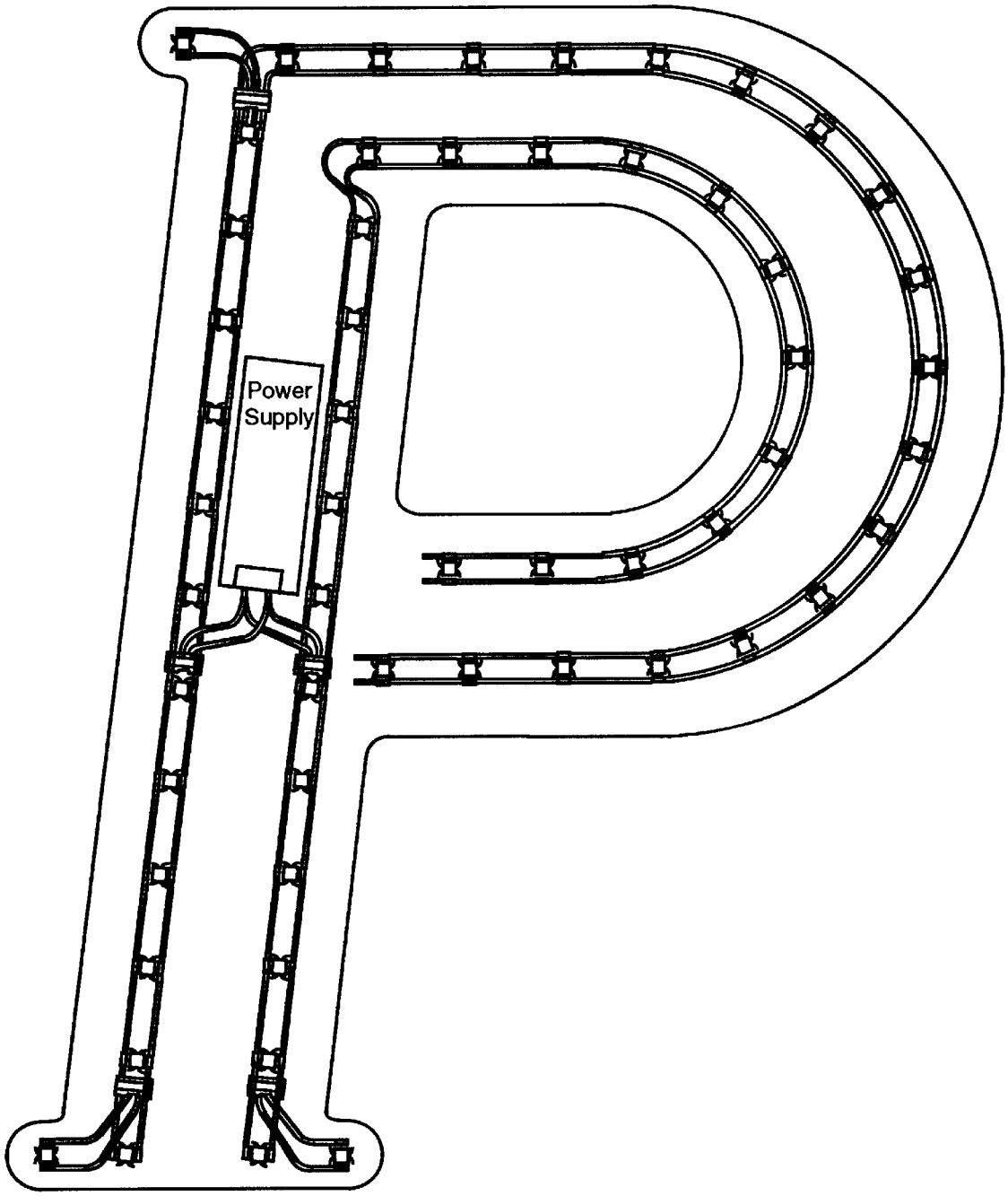
FIG. 4 shows the LED rail attached to the bottom of a channel letter.

The bendable clip can serve as a template for positioning the modules along the bottom of a channel shown in FIG. 4. The bendable clip attaches the modules to the bottom of a channel. The bendable clip can be mounted to the bottom of a channel by tape adhesive, a spray adhesive, or rivet pins. The bendable clip is made from metal. The bendable clip conducts the heat out through the adhesive tape to the channel, and the channel then conducts (by conduction, convection, or radiation) the heat to its surroundings. The bendable clip also conducts some of the heat directly into the air or surrounding as depicted by the heat path through the sidewalls.

Figure 5A:
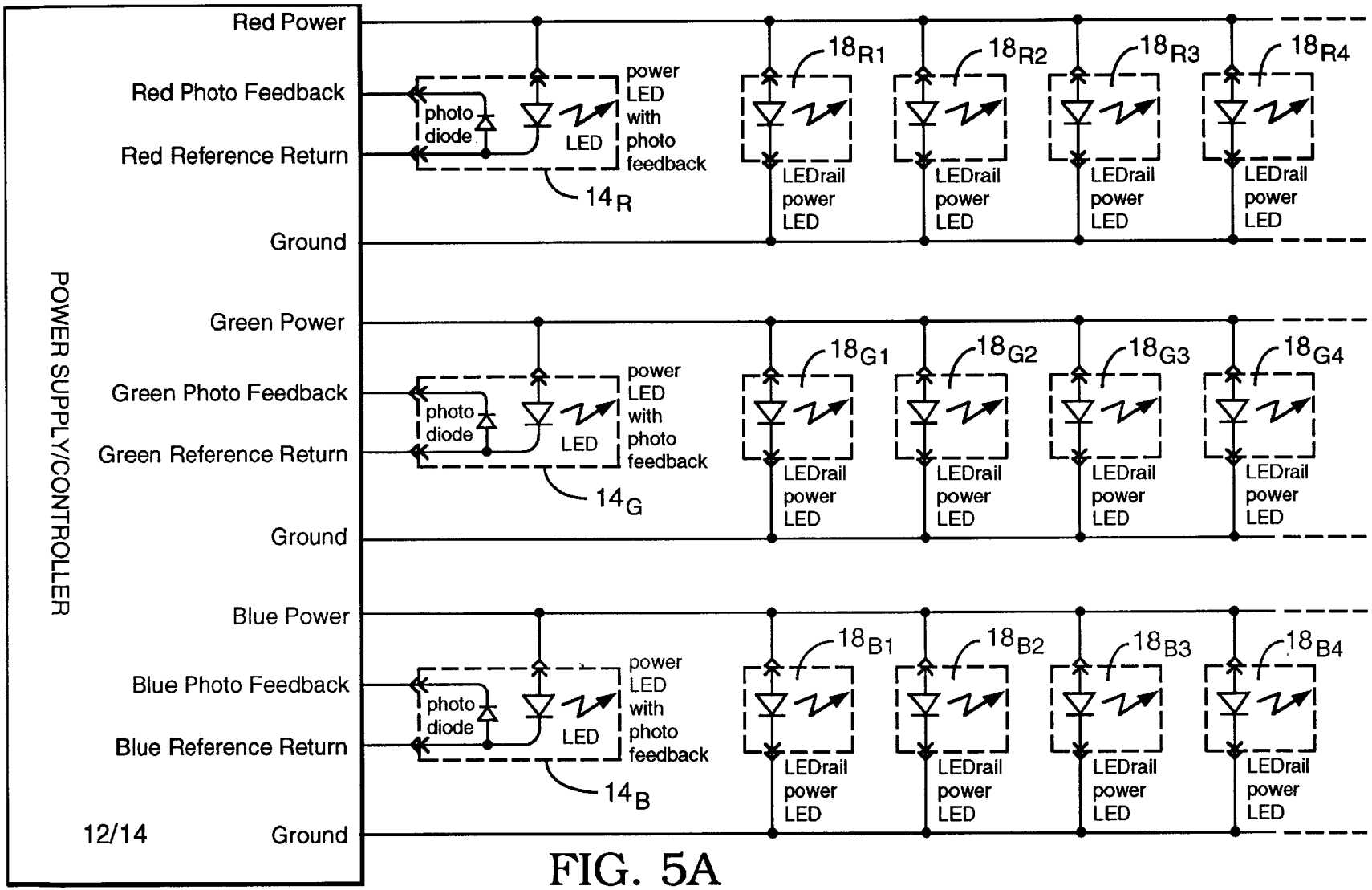
FIGS. 5A–B illustrate multiple color LED rail embodiments.
Figure 5B:
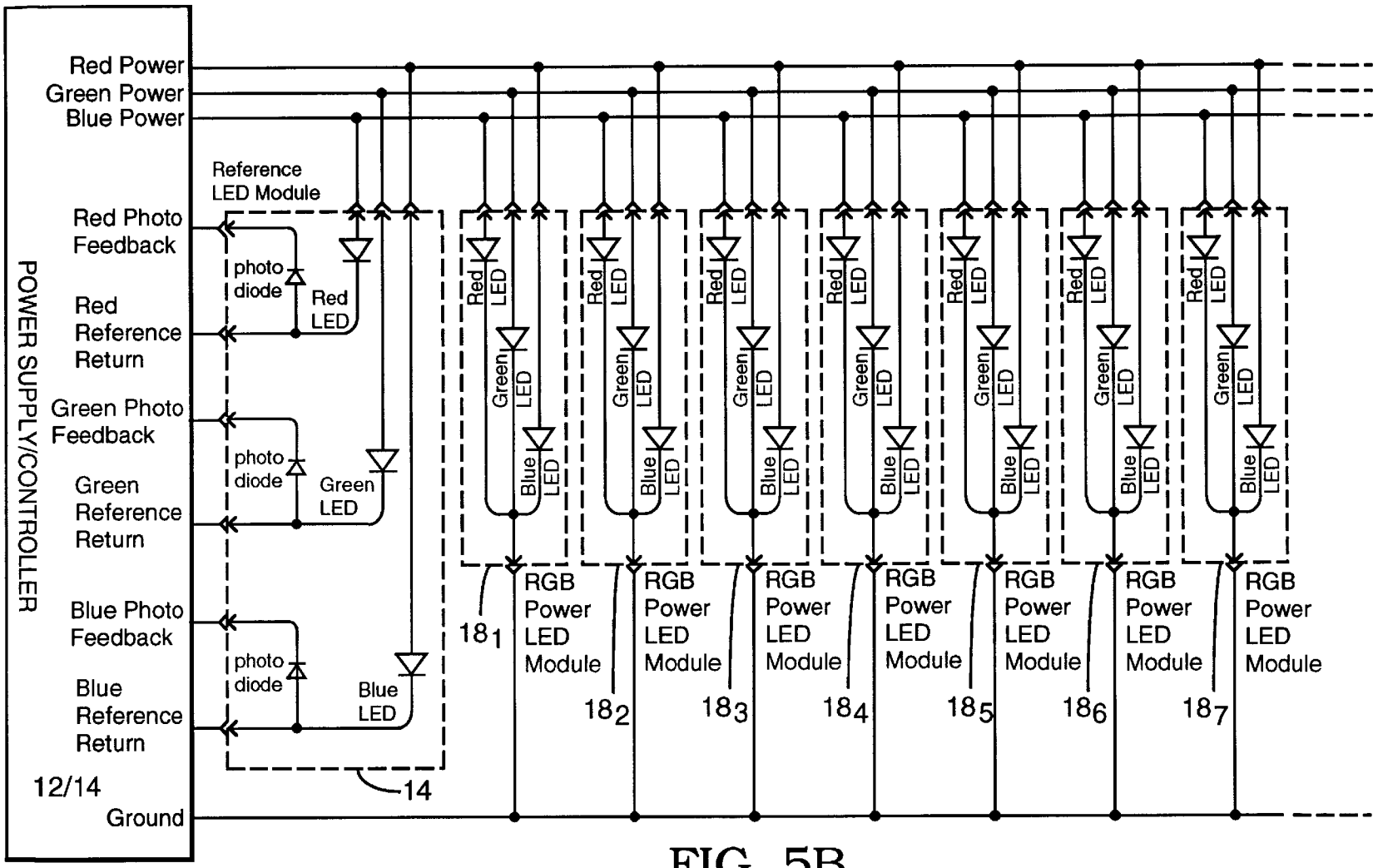

FIGS. 5A–B illustrate schematic diagrams for the multiple color LED rails. In FIG. 5A, the power supply/system controller 12, 14 connected to three discrete LED rails. In FIG. 5B, the three LED rails are integrated into the same module. Two or three color LED rails can be controlled in combination to create white light and other colors. The LEDs within a string are matched with the first module having an integrated photodiode to feedback light level. The system controller measures the light level from a reference LED matched to the string and sets current/voltage to maintain the desired color mix.

I claim:

1. A flexible light assembly comprising:

a bendable frame wherein the bendable frame is bendable into a desired shape;

a plurality of modules, each of the modules being a separate piece and mechanically connected to the bendable frame, wherein each of the modules comprises:

a positive connector;

a negative connector;

a light emitting device electrically connected to the positive connector and to the negative connector;

a positive track; and a negative track;

a positive electrical wire running along said bendable frame, wherein the positive electrical wire is positioned in the positive track of each of the modules and is electrically connected to the positive connector of each of the modules; and a negative electrical wire running along the bendable frame, wherein the negative electrical wire is positioned in the negative track of each of the modules and is electrically connected to the negative connector of each of the modules.

2. The flexible light assembly of claim 1, wherein the light emitting device is a light emitting diode.

3. The flexible light assembly of claim 1, wherein each of the modules further comprises a clip, and wherein each of the modules is mechanically connected to the bendable frame with the clip.

4. The flexible light assembly of claim 1, wherein each of the modules fiber comprises an adhesive, and wherein each of the modules is mechanically connected to the bendable frame with the adhesive.

5. The flexible light assembly of claim 1 further comprising a controller for all light emitting devices, the controller being electrically connected to the positive electrical wire and the negative electrical wire.

6. The flexible light assembly of claim 5 further comprising a reference circuit electrically connected to the controller, the reference circuit comprising a photodetector receiving light from a reference light emitting device and generating a signal corresponding to a brightness of the reference light emitting device, wherein the controller receives the signal and adjusts the brightness of other light emitting devices based on the signal.

7. The flexible light assembly of claim 6, wherein each module contains light emitting devices that emit a plurality of colors, the reference circuit generating a separate signal for each color light.

8. The flexible light assembly of claim 1, wherein each module contains light emitting devices that emit a plurality of colors.

9. The flexible light assembly of claim 8 further comprising a controller for all light emitting devices, the controller being electrically connected to the positive electrical wire and the negative electrical wire as well as other wires connected to different color light emitting devices in the modules, the controller controlling a brightness level of each color in the plurality of colors so as to generate a variable mixture of colors.

10. The flexible light assembly of claim 8 wherein said plurality of colors comprises red, green, and blue.

11. The flexible light assembly of claim 1 further comprising a channel in which the bendable frame is positioned.

* * * * *